US005496570A

United States Patent [19]

Mauss et al.

[11] Patent Number: 5,496,570

[45] Date of Patent: Mar. 5, 1996

[54] APPARATUS FOR SPREADING PARTICULATE MATERIALS

[75] Inventors: Dieter Mauss; Jürgen Pesch, both of Krefeld; Friedhelm Schlüpen, Straelen, all of Germany

[73] Assignee: Siempelkamp GmbH & Co., Krefeld, Germany

[21] Appl. No.: 187,770

[22] Filed: Jan. 27, 1994

[30] Foreign Application Priority Data

Feb. 2, 1993 [DE] Germany ..... 43 02 850.0

[51] Int. Cl.[6] ..... B28B 5/02

[52] U.S. Cl. ..... 425/83.1; 425/80.1; 425/367

[58] Field of Search ..... 425/80.1, 81.1, 425/83.1, 367, 141, 145, 82.1

[56] References Cited

U.S. PATENT DOCUMENTS

| | | | |
|---|---|---|---|
| 3,864,066 | 2/1975 | Gerhardt | 425/83.1 |
| 4,037,723 | 7/1977 | Wahl et al. . | |
| 4,063,858 | 12/1977 | Axer et al. | 425/83.1 |
| 4,068,991 | 1/1978 | Ufermann et al. . | |
| 4,308,227 | 12/1981 | Ufermann | 425/83.1 |
| 4,388,055 | 6/1983 | Ufermann | 425/83.1 |
| 4,389,175 | 6/1983 | Sakschek | 425/83.1 |
| 4,494,919 | 1/1985 | Knudson et al. | 425/83.1 |
| 5,202,133 | 4/1993 | Pesch et al. | 425/83.1 |

FOREIGN PATENT DOCUMENTS

| | | | |
|---|---|---|---|
| 2535461 | 2/1978 | Germany . | |
| 2735510 | 5/1980 | Germany . | |
| 3109151 | 10/1982 | Germany | 425/83.1 |

*Primary Examiner*—Khanh P. Nguyen
*Attorney, Agent, or Firm*—Herbert Dubno

[57] ABSTRACT

A spreader for glue-coated particles for the production of particleboard in a steel belt continuous press has a clump breaker with at least two disintegrating rollers which are provided with peripheral rows of equispaced teeth equispaced axially along each roller. The rows of teeth of the two rollers interdigitate to form a gap of meandering shape of a gap width determining the disintegrating resolution of the clump breaker.

8 Claims, 4 Drawing Sheets

FIG. 3
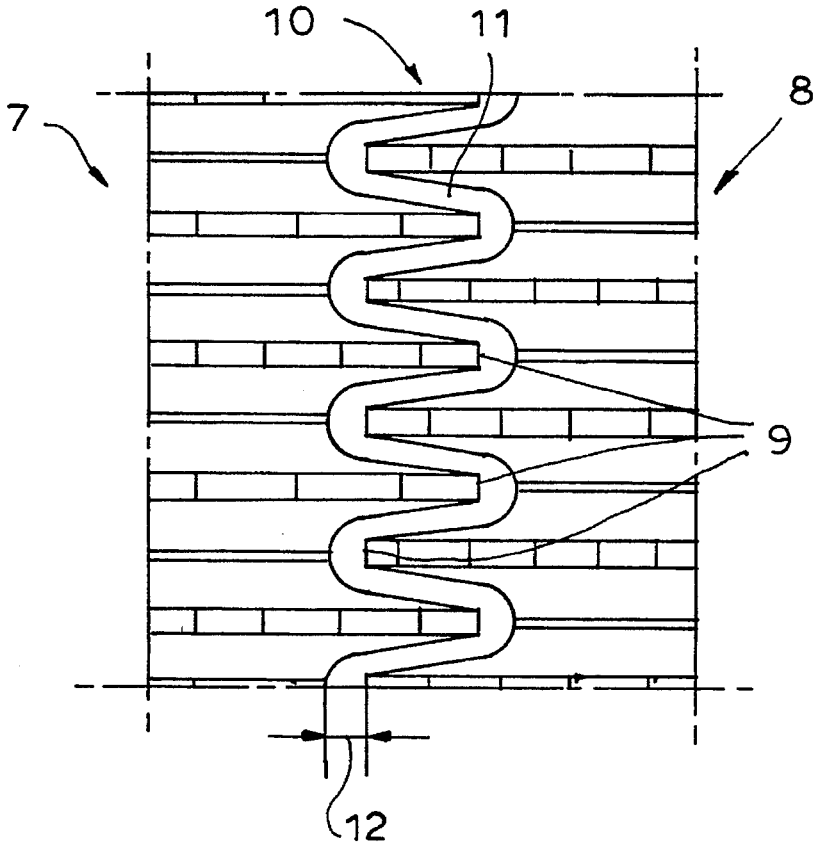
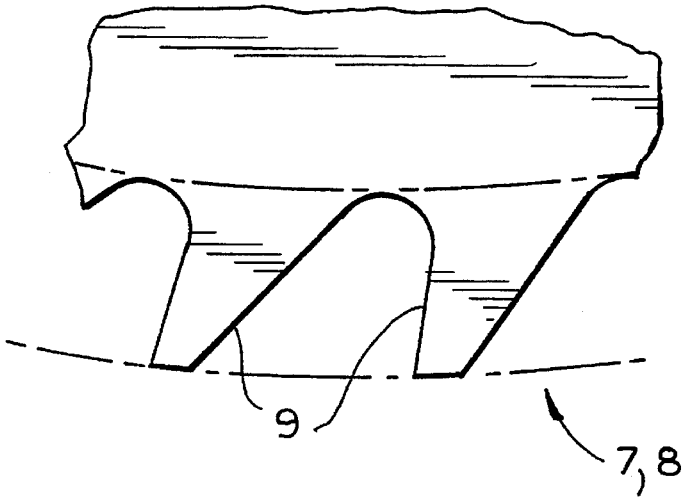
FIG. 5

APPARATUS FOR SPREADING PARTICULATE MATERIALS

FIELD OF THE INVENTION

Our present invention relates to an apparatus for spreading particulate material and, more particularly, to an apparatus for forming a mat of a particulate material coated with a binder especially for pressing into pressed board in a continuous steel belt press. The invention is particularly intended for glue-coated particles for the production of pressed board but can be used also for the production of hardened boards like plasterboard, utilizing hydratable binders, i.e. binders which are set by combination with water of hydration.

BACKGROUND OF THE INVENTION

In the production of pressed board it is a standard practice to spread glue-coated particles of a spreadable material in at least one layer on a conveyor or the like forming a receiving surface to constitute a mat which can be carried into a press and there subjected to pressing, e.g. hot pressing, to activate the binder and produce a pressed board.

Such pressed board, also commonly referred to as particleboard, may contain cellulosic fibers, sawdust, wood particles or the like and typical glues which may be used include phenolic or resorcinol-based thermosetting adhesives.

A typical press for this purpose is a continuous steel-belt press between the belts of which the mat is fed and from which emerges a continuous body which can be cut into the individual boards.

The steel belts may move between the press platens via the intermediary of rollers or the like.

In a prior practice, the formation of the mat utilized a bin containing the glue-coated particles and a discharge roll device which metered those coated particles from the bin onto the receiving surface. Between the receiving surface and the discharge roll device, a spreading head was provided. The usual approach was to deposit the particles directly upon the spreading head and allow the spreading head to spread the particles in the form of a mat on the surface.

In practice that approach was found to yield singular regions of the mat of higher density or more compact character than other regions. The local regions of more compact character generally resulted from clumps in the spreadable material, both as a result of the agglomeration of particles because of the presence of the glue or binder, and because particles tended to hook together.

The clumps of the spreadable material resulted not only in inhomogeneity of the finished board, i.e. local regions of greater density or lesser density, but also damage to the press belts when continuous steel-belt presses were utilized. The damage could cause buckling of the relatively thin steel belts or other permanent deformation thereof. As a result, the press itself had a limited life.

OBJECTS OF THE INVENTION

It is, therefore, the principal object of the present invention to provide an improved spreading apparatus which can overcome the drawbacks outlined above.

More specifically, it is an object of the invention to provide a spreading apparatus for the formation of continuous mats, e.g. for pressing into pressed board in a continuous steel-belt press, whereby the aforementioned clumps are eliminated or the likelihood that such clumps will be present in the mat is greatly reduced.

It is also an object of this invention to provide an improved spreading apparatus which can lead to increased life of a continuous steel-belt press utilized in conjunction therewith.

SUMMARY OF THE INVENTION

These objects and others which will become apparent hereinafter are attained, in accordance with the present invention, in an apparatus for spreading glue-coated particulate material to form mats for the production of particleboard, especially from wood particles, utilizing a continuous steel-belt press.

The apparatus comprises a bin containing the spreadable material with a discharge roll unit for feeding the particles from the bin, a spreading head with a multiplicity of spreading rollers, and a mat-forming stretch with a continuously driven spreading belt. As noted, in the flow of the spreadable material singular formations of increased density, i.e. clumps, can occur.

According to the invention in this flow between the bin and the belt at least one clump breaker is provided with a pair of axially parallel, counterrotating cylindrical disintegrating rollers with rows of disintegrating teeth.

The rows of disintegrating teeth overlap one another, i.e. the rows of the two rollers interdigitate and in the overlapping region form a disintegrating gap of meandering configuration, through which the particle stream flows. The gap width determines the disintegrating resolution of the clump breaker. The reference to a gap of meandering shape includes, of course, meanders of zig-zag configuration or wave-shaped meanders.

It is true that disintegrating units have been provided in the flow of glue-coated particles heretofore (see German Utility Model DE-GM 19 83 284). In this case the spreading rollers are formed with a brush roller with a long brush juxtaposed with a toothed disintegrating roller. No meandering gap is here formed and in practice this system has been found to be unsatisfactory. Indeed, tests have shown that this earlier disintegrating unit cannot operate with a defined disintegrating resolution.

The disintegrating resolution in the sense of the invention is, of course, the maximum particle size of a particle which can pass through the gap without being broken down further. The maximum size, of course, can be set by adjusting the gap width or by predetermining the gap width at the set up or the construction of the apparatus.

According to a feature of the invention, the clump breaker can be provided between the inlet side of the head and the discharge roll device at the outlet of the bin.

Advantageously the two disintegrating rollers have the same roll diameter. In a preferred embodiment, the two rolls also have teeth of the same shape, spacing and arrangement.

It has been found to be advantageous to incline the disintegrating teeth counter to the sense of rotation of the rolls so that the teeth have a sawtooth-like pattern.

Means can be provided for adjusting the gap width and thus for adjusting the disintegrating resolution. It has been found to be advantageous, moreover, to offset the two rolls from one another in the horizontal direction and to provide means for adjusting this offset. In this manner, the direction in which the particles are cast onto the spreading head and can be varied.

In a preferred embodiment of the invention, the rolls can be driven at different speeds from one another. This has the advantage of applying to the flow of spreadable material different shear effects which can depend on the relative peripheral speeds and angular velocities of the rolls. In fact, the difference in the peripheral speeds can constitute a control parameter of the system which allows the disintegrating resolution to be finely controlled and adjusted so that even very small local regions of higher density cannot occur in the mat.

More particularly, the apparatus for spreading the particles comprises:

a driven continuous band forming a mat-receiving surface;

a bin above the mat-receiving surface containing particles coated with binder to be spread in a mat on the surface;

a discharge roll device at an outlet of the bin for feeding the particles from the bin; and means for forming a spreading head between the device and the surface for spreading the particles in at least one layer forming the mat on the surface, the apparatus comprising:

between the bin and the surface at least one clump breaker having at least one pair of mutually parallel, generally horizontal, counterrotating and generally cylindrical disintegrating rollers each having a plurality of circumferential rows of equispaced disintegrating teeth with the rows being equispaced axially from one another, the rows of teeth of the two rollers interdigitating in a radial overlapping region forming between the rollers an axially meandering gap traversed downwardly by the particles and of a gap width determining a disintegrating resolution of the clump breaker.

BRIEF DESCRIPTION OF THE DRAWING

The above and other objects, features, and advantages will become more readily apparent from the following description, reference being made to the accompanying drawing in which:

FIG. 3 is a plan view on still a larger scale of the meander region of the rollers of FIG. 2;

FIG. 5 is an elevational view drawn to a larger scale of the region V of FIG. 4.

SPECIFIC DESCRIPTION

Figure 1:
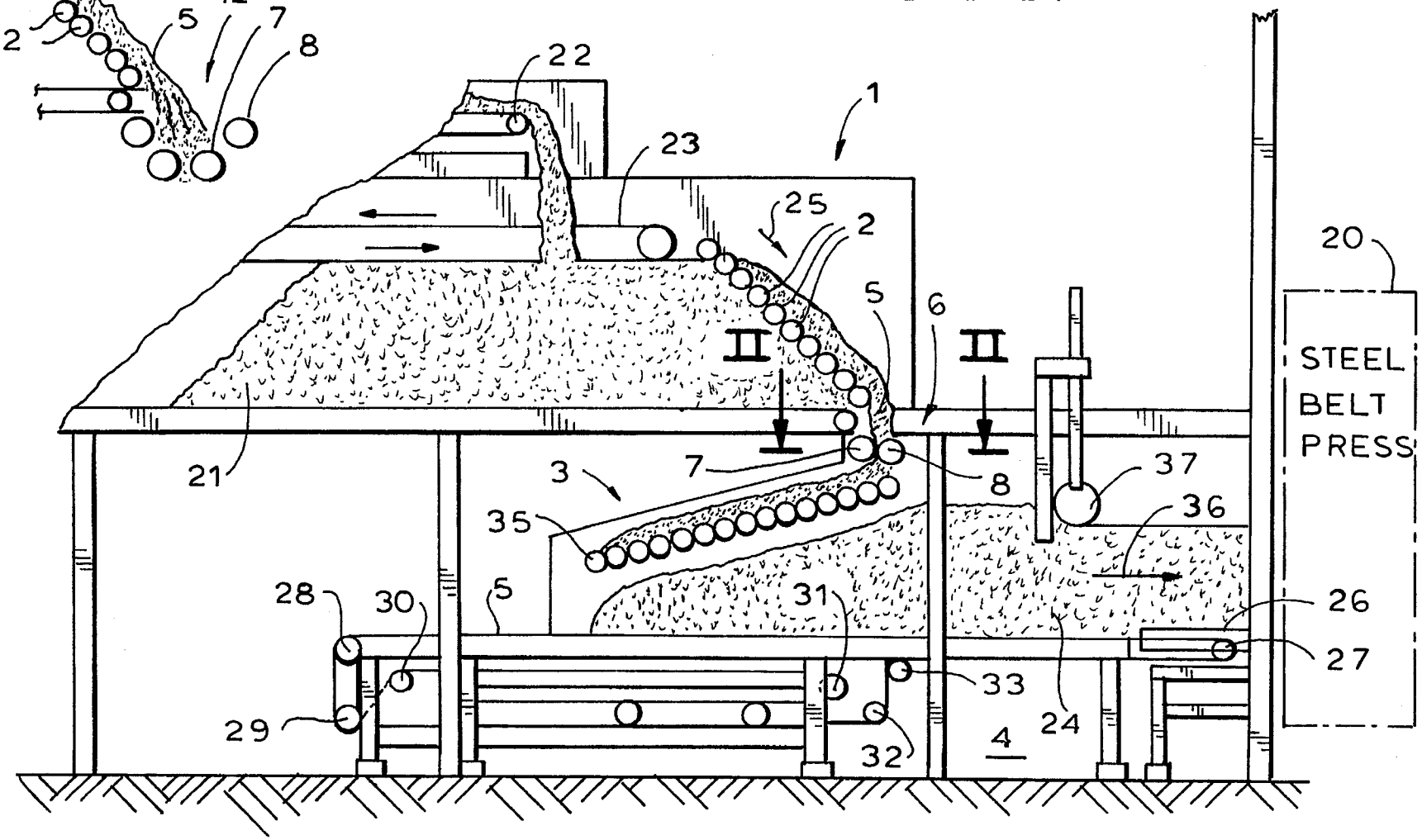
FIG. 1 is a schematic vertical section through an apparatus embodying the invention.
Figure 2:
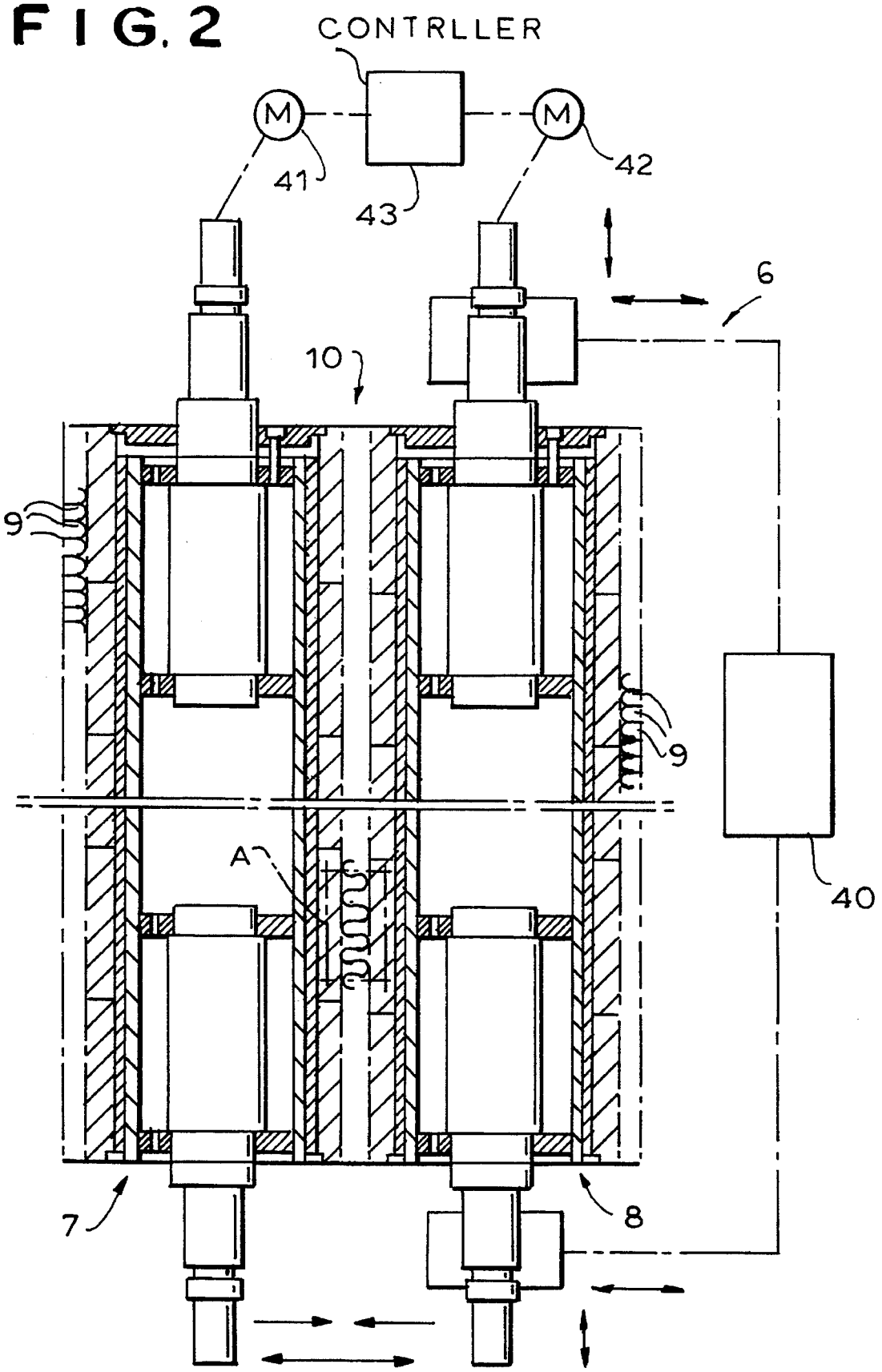
FIG. 2 is a cross sectional view taken along the line II—II of FIG. 1 drawn to a larger scale.

In FIGS. 1–3, we have shown a spreading apparatus upstream of a continuous steel-belt press 20 which comprises a bin or bunker 1 for a mass 21 of wood particles coated with a thermosetting glue and which is supplied with these particles by a conveyor belt 22. The spreadable material is represented generally at S and, in the bin 1, a leveling belt 23 serves to maintain a constant level of the mass 21 which is progressively moved toward the discharge side of the bin.

At the discharge side of the bin a discharge roll device represented at 2 is provided to feed the particulate material S at the requisite rate for building up a mat 24 in the direction of arrow 25 to the outlet from which the flow of particulate material cascades onto a clump breaker 6 upstream of a spreading head 3 above a receiving surface 5 formed by an endless belt 26 passing over rollers 27, 28, 29, 30, 31, 32 and 33.

The spreading head 3 can comprise a multiplicity of rollers 35 which can be in the form of axially stacked interdigitating disks enabling the particulate material to trickle through spaces between these disks to form the mat 24. The latter is displaced by the belt 26 in the direction of arrow 36 which may be levelled at 37 before it is engaged between the steel belt of the press 20. In the apparatus, clumps can form before the particles reach the mat and when these clumps are incorporated in the mat, they constitute regions of locally high density which can damage the belts of the press or can create inhomogeneities in the pressed board.

Consequently, the clump breaker 6 has been provided, in this case, between the head 3 and the discharge roll device 2.

The clump breaker 6 here comprises a pair of counterrotating driven disintegrating rollers 7, 8, whose axes can be parallel to one another and which are generally cylindrical.

As the need arises, a plurality of such clump breakers 6 can be provided in cascade or the rollers of the spreading head 3 can be constituted as disintegrating rollers as will be described for the rollers 7 and 8 so that they can function similarly.

Figure 4:
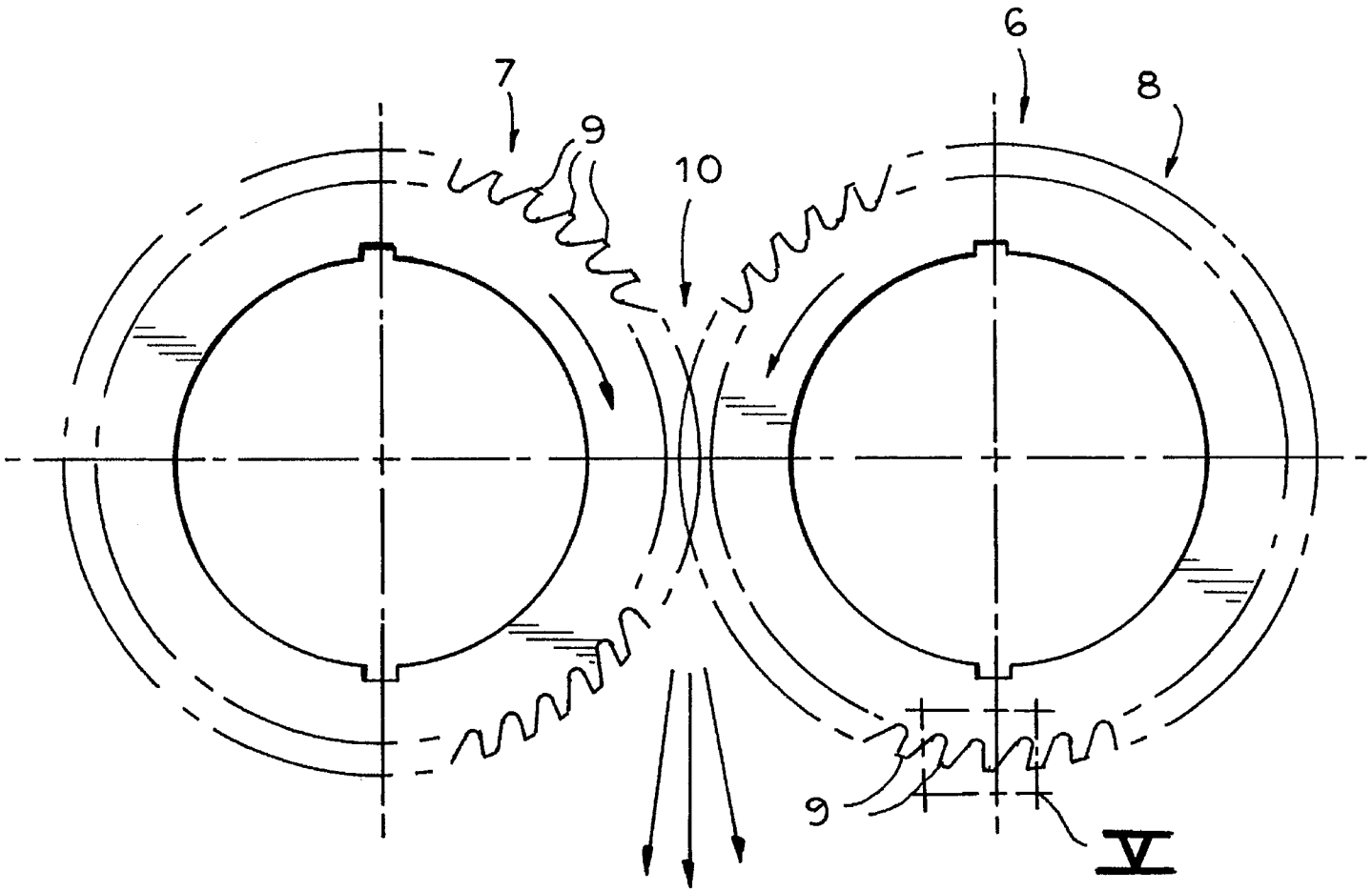
FIG. 4 is a side view diagrammatically illustrating another pair of disintegrating rollers.

As can be seen in FIGS. 2 and 3, the rollers 7 and 8 have peripheral rows of equidistant teeth 9 which can have the same configuration as the teeth shown in FIG. 4.

These rows of disintegrating teeth 9 are axially spaced apart on each roller 7, 8 equidistantly.

As can be seen especially from FIG. 3, the rows of the disintegrating teeth 9 interdigitate for the two rollers 7, 8 in an overlapping region 10 and within this overlapping region 10, a disintegrating gap 11 of meander configuration is formed. The gap width 12 of the gap 11 determines the disintegrating resolution of the clump breaker 6. The gap width preferably is in the range of 1 to 3 mm. Reference may also be had to FIG. 4 for the showing of the overlapping region 10 in greater detail.

The clump breaker 6 is provided at the inlet side of the spreading head 3. The disintegrating rollers ? , 8 have the same diameter and identical configurations of the teeth 9.

As can be seen from FIGS. 4 and 5, the disintegrating teeth can be inclined counter to the sense of rotation of the rollers 7 and 8 in a sawtooth pattern.

As can be seen from FIG. 3 and as represented by the arrows, the gap width 12 can be adjusted by relatively moving the rollers 7, 8 in the radial direction to adjust the disintegrating resolution. For this purpose an effector 40, such as a servomotor, coupled to one of the rollers 7, 8, e.g. the roller 8 as shown in FIG. 2, can be provided. This servomotor can displace the roller 8 also in the axial direction horizontally to adjust any offset between the rollers.

The axes of the two rollers need not be in the same horizontal plane, i.e. the vertical orientation of one roller relative to the other can be adjusted as well.

The rollers may have separate motors 41 and 42 for driving them at respective speeds and provided with a common controller 43 which adjusts the relative speeds of the rollers 7 and 8. The clump breaker can also break down clumps of glue as well as clumps of particles coated with the glue.

Figure 6:
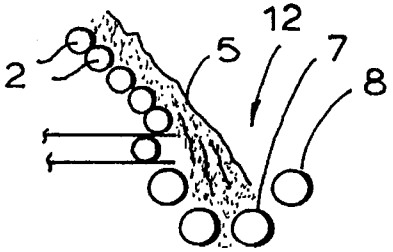
FIG. 6 is an illustration similar to FIG. I of an embodiment in which the disintegrating rollers form the spreading head.

As can be seen from FIG. 6 moreover, the clump breaker can be formed with or as part of the spreading head. In that case, more than two disintegrating rollers 7, 8 can form an array lying in an inclined plane like the array of rollers 35 in FIG. 1. Alternatively, as shown in FIG. 6, four disintegrating rollers can be provided which define an upwardly open pocket 12 into which the coated particles can flow before they are spread in the mat 24 on the belt 26.

We claim:

1. An apparatus for spreading particles coated with binder in a mat for the production of a pressed board in a continuous steel-belt press, said apparatus comprising:

a driven continuous band forming a mat-receiving surface displaceable in a given direction;

a bin above said mat-receiving surface containing particles coated with binder to be spread in a mat on said surface;

a discharge roll device at an outlet of said bin for feeding said particles from said bin;

means for forming a spreading head between said device and said surface for spreading said particles in at least one layer forming said mat on said surface, said spreading head comprising:

between said bin and said surface at least one clump breaker having at least one pair of mutually parallel, generally horizontal, counterrotating and generally cylindrical disintegrating rollers extending perpendicular to said direction, each of said rollers having a plurality of circumferential rows of equispaced disintegrating teeth with the rows being equispaced axially from one another, the rows of teeth of the two rollers interdigitating in a radial overlapping region forming between said rollers an axially meandering gap of ziz-zag or wave shape traversed downwardly by said particles and of a gap width determining a disintegrating resolution of the clump breaker, the disintegrating teeth being inclined in a direction opposite the sense of rotation of the respective roller in a sawtooth pattern, said rollers being horizontally offset from one another; and means for adjusting the horizontally offset of one of said rollers relative to the other of said rollers.

2. The apparatus defined in claim 1 wherein the clump breaker is provided at an inlet side of said head downstream of said discharge roll device.

3. The apparatus defined in claim 1 wherein said rollers have the same diameter.

4. The apparatus defined in claim 1 wherein said rollers have the same shape and arrangement of the disintegrating teeth.

5. The apparatus defined in claim 1, further comprising means for adjusting the width of said gap connected to at least one of said rollers.

6. The apparatus defined in claim 1, further comprising means connected to said rollers for varying the sense of rotation thereof.

7. The apparatus defined in claim 1, further comprising means connected to said rollers for varying the rotational speeds thereof.

8. The apparatus defined in claim 1 wherein said rollers have the same diameters and have disintegrating teeth of the same shape and spacing, each row of disintegrating teeth forming a sawtooth pattern, said apparatus further comprising means for varying said width of said gap and varying relative rotational speeds of said rollers.

* * * * *